US006715730B2

(12) United States Patent
Ehr

(10) Patent No.: US 6,715,730 B2
(45) Date of Patent: Apr. 6, 2004

(54) SECURITY WATER CONTROL

(76) Inventor: Jerry A. Ehr, 171 Mission Rd. W., Bloomington, MN (US) 55420

( * ) Notice: Subject to any disclaimer, the term of this patent is extended or adjusted under 35 U.S.C. 154(b) by 281 days.

(21) Appl. No.: 09/748,438

(22) Filed: Dec. 27, 2000

(65) Prior Publication Data

US 2002/0078994 A1 Jun. 27, 2002

(51) Int. Cl.[7] ..... F17D 5/06; E03C 1/05
(52) U.S. Cl. ..... 251/129.04; 4/623
(58) Field of Search ..... 4/623; 137/624.11, 137/624.12; 251/129.04

(56) References Cited

U.S. PATENT DOCUMENTS 4,308,911 A * 1/1982 Mandl ..... 165/22
4,651,777 A * 3/1987 Hardman ..... 251/129.04 X
4,779,839 A * 10/1988 Sears ..... 251/129.04 X
4,921,012 A * 5/1990 Bratten ..... 251/129.04 X
5,033,508 A * 7/1991 Laverty, Jr. ..... 251/129.04 X
5,347,264 A * 9/1994 Bjorkman ..... 340/611
5,409,037 A * 4/1995 Wheeler et al. ..... 137/551
5,984,262 A * 11/1995 Parsons et al. ..... 251/129.04
6,250,601 B1 * 6/2001 Kolar et al. ..... 251/129.04

* cited by examiner

*Primary Examiner*—Kevin Lee
(74) *Attorney, Agent, or Firm*—Norman P Friederichs; Friederichs Law Firm

(57) ABSTRACT

A security system including mechanism for detecting intrusion into a building such as a home, mechanism for activating the detecting mechanism, mechanism for turning off the supply of water to the outdoor water outlet, the activating mechanism including mechanism for controlling the shutting off mechanism to prevent supply of water to the outlet when the detecting mechanism has been activated.

8 Claims, 1 Drawing Sheet

SECURITY WATER CONTROL

FIELD OF THE INVENTION

The present invention relates to water controls for residential use and more particularly to a device for shutting off water flow whenever the security system is activated.

BACKGROUND OF THE INVENTION

A wide variety of control devices have been provided for water systems in the past. The simplest of such devices is of course the hand operated valve. Even such hand operated valves have undergone innovation and development for many years. New developments in recent years have found valves that are electrically operated and that serve to sense leakage and automatically close the valve upon sensing leakage. Illustrative of such electically operated water valves are those shown in U.S. Pat. No. 5,409,037.

A risk of vandalism has existed for many years. Kids for example, while roaming through a neighborhood may turn on the outdoor water valve and fail to turn the valve off. In some instances the act may come from the children simply playing in the water and failing to turn the water off when they complete the play. In other instances the act of turning the water on may be one of vandalism. In either event the cost of the water and the cost of the adverse effects of too much water adjacent the water outlet may be costly. The water may for example seep into the home and cause extensive damage to the inside of the home.

The present invention overcomes the risk by providing an automatic shut off of the water line while the home owner is gone on vacation or out of town on business.

SUMMARY OF THE INVENTION

The present invention includes a security system having mechanism for sensing intrusion within a residence. The security system may be activated by the simple flip of a switch.

Alternatively the activation of the system may be a complex setting of timing mechanism which controls the time period during which the security system is active. The intrusion sensing mechanism may sense sound or movement within a residence. The sensing of intrusion then provides a signal that serves to provide security activity. The signal may be an electronic signal to a law enforcement agency. The law enforcement goes to the residence to check on the intrusion and intercept anyone that has entered to residence. In the alternative, the signal may be to a remote location where the recipient of the signal then acts to provide the security intercept by calling the local law enforcement to check out the residence.

The present security system includes mechanism for turning off the water system within the residence. This mechanism may include a locking device in the valve or water faucet on the outside of the residence. Alternatively, the locking device may be an electronically controlled valve within the residence. This internal electronically controlled valve may be placed at the point where the water initially enters the residence or at any other desired location within the home. The water control mechanism may be automatically activated when the security system is activated. In other words, when the home owner leaves on vacation, the home owners activates the security system. The electronically controlled valve is actuated by this activation of the security system.

IN THE DRAWINGS

DETAILED DESCRIPTION OF THE INVENTION

Figure 1:
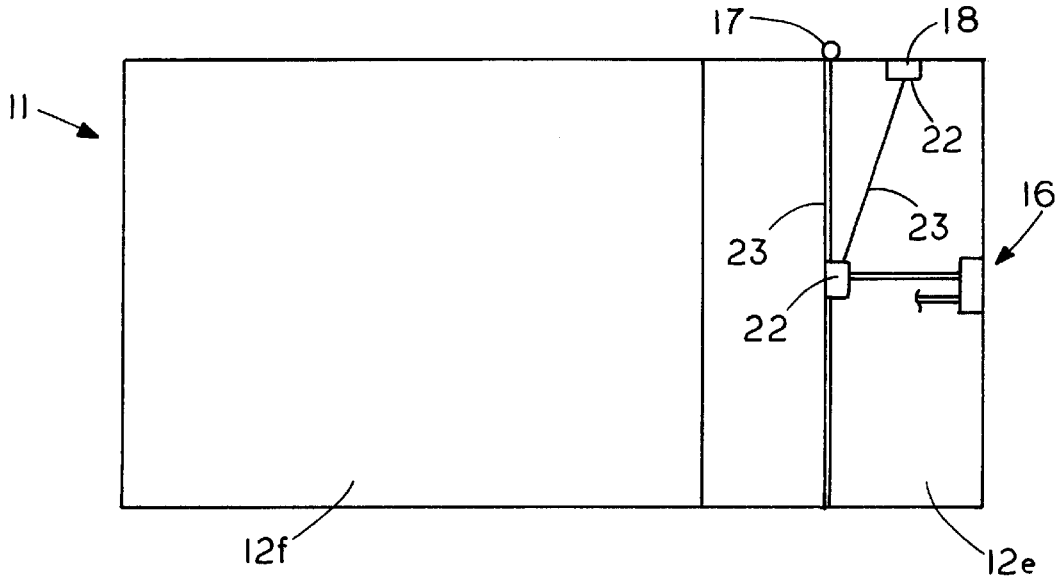
FIG. 1 is a floor plan of a residence illustrating use of the present invention.
Figure 2:
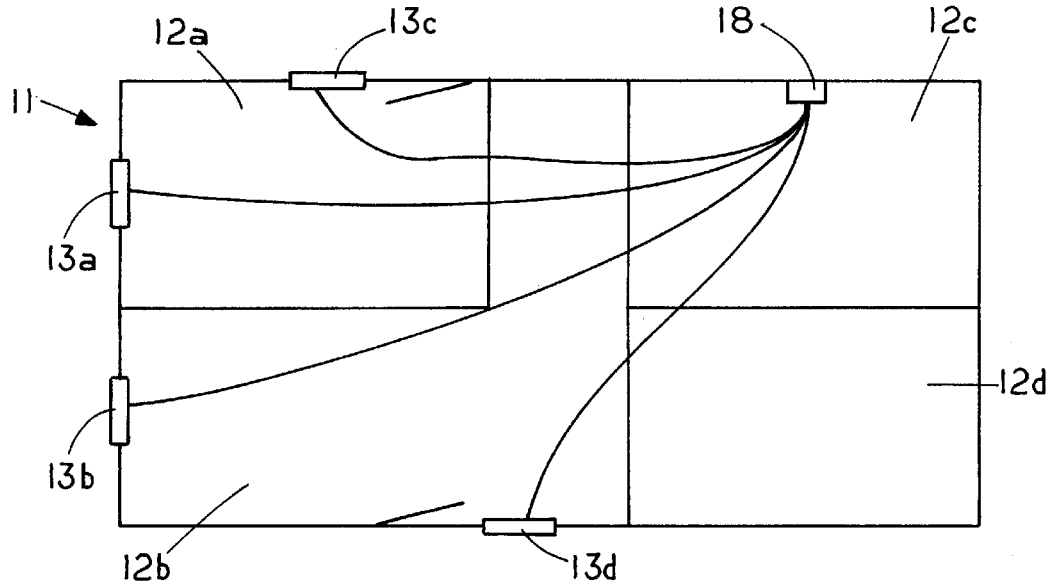
FIG. 2 is a schematic diagram of the present security system.

The security system 10 the present invention be disposed in any building desired to be protected, such as a residential home 11. The residence 11 may include a plurality of rooms 12. The residence includes a water system 16 which may include one or more outside water outlets or faucets 17, such as for water the lawn, flower beds and trees.

The security system 10 may include a central control 16 and a plurality of sensing mechanisms 12*a*. One of such sensing mechanisms 12*a* is disposed in each of the various rooms such as 12, respectively. The sensing mechanism 12*a* may be of any conventional construction such as a small unobtrusive microphone. The appropriate microphone, such as microphone 12*a*, is adapted to sense sound in the room 12 such as breaking of glass or the forcible entry of a door. The signal from the microphone is transmitted to the central control 16 which includes electronic circuitry that senses the decibel level of the sound in the room. If the decibel level is above a predetermined level a signal is sent to the security enforcement system, such as the local police.

The present security system 10 includes an electronic control valve 22 disposed in the water line 23. The electronically controlled valve may be of any suitable type such as the electronic valves shown in U.S. Pat. No. 5,409,037. The electronic control valve 22 is disposed at any location upstream of the outside water outlet 17. If the water system includes a plurality of water outlets 17, the control valve 22 may be located upstream of all of the water outlets.

The water control mechanism 22 may be automatically activated when the security system 10 is activated. In other words, when the home owner leaves on vacation, the home owners activates the security system 10. The electronically controlled valve 22 is actuated by this activation of the security system. Alternatively, the water control mechanism 22 may include a sound sensitive mechanism that serves to turn the water system off when sound is sensed in the area adjacent to the water line.

What is claimed is:

1. A security system comprising means for detecting intrusion, means for activating said detecting means, means for shutting off supply of water to an outdoor water outlet, and said activating means including means for controlling said shutting off means to prevent supply of water to said outlet when said detecting means has been activated.

2. The security system of claim 1 wherein said shutting off means comprise an electrically controlled valve.

3. The security system of claim 1 wherein said security system includes central control means.

4. The security system of claim 3 wherein said central control means includes electronic circuitry that senses the decibel level of the sound in the area adjacent to the water outlet.

5. The security system of claim 2 wherein said system includes a central control and a plurality of sensing mechanisms.

6. The security system of claim 2 wherein said electrically controlled valve is disposed immediately up stream of said outlet.

7. The security system of claim 2 wherein said electrically controlled valve is disposed up stream of at least two outlets, thereby controlling both outlets.

8. The security system of claim 1 wherein said means for shutting off supply to outdoor water outlet is activated by sound adjacent the water supply outlet.

* * * * *